US010816179B2

(12) United States Patent
Nimma et al.

(10) Patent No.: US 10,816,179 B2
(45) Date of Patent: Oct. 27, 2020

(54) LIGHTING FIXTURE

(71) Applicant: Eaton Intelligent Power Limited, Dublin (IE)

(72) Inventors: Sridhar Reddy Nimma, Cumming, GA (US); Matthew A. Davis, Orange, CA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/436,421

(22) Filed: Jun. 10, 2019

(65) Prior Publication Data

US 2019/0309935 A1 Oct. 10, 2019

Related U.S. Application Data

(63) Continuation of application No. 14/837,597, filed on Aug. 27, 2015, now Pat. No. 10,317,060.
(Continued)

(51) Int. Cl.

| | |
|---|---|
| ***F21V 31/00*** | (2006.01) |
| ***F21V 23/00*** | (2015.01) |
| ***F21S 8/08*** | (2006.01) |
| ***F21V 5/00*** | (2018.01) |
| ***F21V 21/116*** | (2006.01) |
| ***F21V 23/04*** | (2006.01) |
| ***F21V 19/00*** | (2006.01) |

(Continued)

(52) U.S. Cl.
CPC ..... *F21V 23/005* (2013.01); *F21S 8/086* (2013.01); *F21V 5/007* (2013.01); *F21V 19/003* (2013.01); *F21V 21/116* (2013.01); *F21V 23/008* (2013.01); *F21V 23/0464* (2013.01); *F21V 23/0471* (2013.01); *F21V 31/005* (2013.01); *F21W 2131/103* (2013.01); *F21Y 2105/10* (2016.08); *F21Y 2115/10* (2016.08)

(58) Field of Classification Search
CPC ..... F21W 2131/103
See application file for complete search history.

(56) References Cited

U.S. PATENT DOCUMENTS

| | | | |
|---|---|---|---|
| 8,322,881 | B1 | 12/2012 | Wassel |
| 2008/0123340 | A1 | 5/2008 | McClellan |

(Continued)

FOREIGN PATENT DOCUMENTS

| | | |
|---|---|---|
| EP | 2762766 | 8/2014 |
| GB | 2492761 | 1/2013 |
| KR | 100862540 | 10/2008 |

OTHER PUBLICATIONS

International Search Report for PCT/US2015/047169 dated Nov. 18, 2015.

*Primary Examiner* — Andrew J Coughlin
(74) *Attorney, Agent, or Firm* — King & Spalding LLP

(57) ABSTRACT

A lighting fixture can comprise a substantially flat sheet of metal supporting a circuit that comprises one or more light emitting diodes with one or more associated optics for manipulating emitted light. The circuit can be attached to, mounted next to, or integrated with the sheet of metal. In some examples, a layer of dielectric material adheres to the sheet of metal, and circuit elements adhere to the layer of dielectric material. Such circuit elements may comprise electrical traces, light emitting diodes, and/or a light emitting diode driver. The sheet of metal can provide a substrate for the circuit or a support for a freestanding circuit board that may be rigid or flexible.

20 Claims, 10 Drawing Sheets

Related U.S. Application Data

(60) Provisional application No. 62/042,836, filed on Aug. 28, 2014.

(51) Int. Cl.

| | |
|---|---|
| *F21Y 105/10* | (2016.01) |
| *F21Y 115/10* | (2016.01) |
| *F21W 131/103* | (2006.01) |

(56) References Cited

U.S. PATENT DOCUMENTS

| | | | |
|---|---|---|---|
| 2011/0141728 | A1 | 6/2011 | Russello et al. |
| 2012/0087125 | A1 | 4/2012 | Liu |
| 2013/0155673 | A1 | 6/2013 | Wang et al. |
| 2013/0279172 | A1 | 10/2013 | Wang |
| 2014/0036521 | A1 | 2/2014 | Elliott |
| 2014/0197291 | A1 | 7/2014 | Schultz |

LIGHTING FIXTURE

CROSS REFERENCE TO RELATED APPLICATIONS

This application is a continuation application of and claims priority to U.S. patent application Ser. No. 14/837,597 filed Aug. 27, 2015 and titled "Lighting Fixture," which claims priority to U.S. Provisional Patent Application No. 62/042,836 filed Aug. 28, 2014 and titled "Lighting Fixture". The entire contents of the foregoing applications are hereby incorporated herein by reference.

STATEMENT REGARDING FEDERALLY SPONSORED RESEARCH OR DEVELOPMENT

This invention was made with government support under Contract Number DE_EE0006260 awarded by the United States Department of Energy. The government has certain rights in the invention.

TECHNICAL FIELD

Embodiments of the technology relate generally to lighting fixtures and more specifically to an outdoor luminaire, such as a streetlight, that comprises light emitting diodes and associated circuitry disposed against a metallic substrate.

BACKGROUND

For illumination applications, light emitting diodes (LEDs) offer substantial potential benefit associated with their energy efficiency, light quality, and compact size. However, to realize the full potential of the potential benefits offered by light emitting diodes, new technologies are needed. For instance, relative to incandescent lights, light emitting diodes typically have different thermal properties, different electrical characteristics, different manufacturing requirements, and different mounting constraints.

Accordingly, there are needs in the art for technology to manage heat produced by one or more light emitting diodes. Additional needs exist for lighting fixture configurations that facilitate cost-effective manufacturing. Need further exist for light emitting diode mounting technologies. Need also exists for lighting fixture configurations that facilitate cost-effective manufacturing and for improved technology for powering light emitting diodes. A capability addressing one or more such needs, or some other related deficiency in the art, would support improved illumination systems and more widespread utilization of light emitting diodes in lighting applications.

SUMMARY

In one aspect of the disclosure, a lighting fixture can comprise a sheet of metal, a circuit that comprises one or more light emitting diodes, and one or more optics. The circuit can be disposed adjacent the sheet of metal. The circuit can be attached to, mounted next to, or integrated with the sheet of metal. In some examples, a layer of dielectric material adheres to the sheet of metal, and circuit elements adhere to the layer of dielectric material. Such circuit elements may comprise electrical traces, light emitting diodes, and/or a light emitting diode driver, to mention a few representative examples without limitation. The sheet of metal can provide a substrate for the circuit or a support for a freestanding circuit board that may be rigid or flexible. The optic or optics can manage light emitted by the light emitting diode or diodes.

The foregoing discussion of certain aspects of the disclosure is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made below to the accompanying drawings.

Figure 1A:
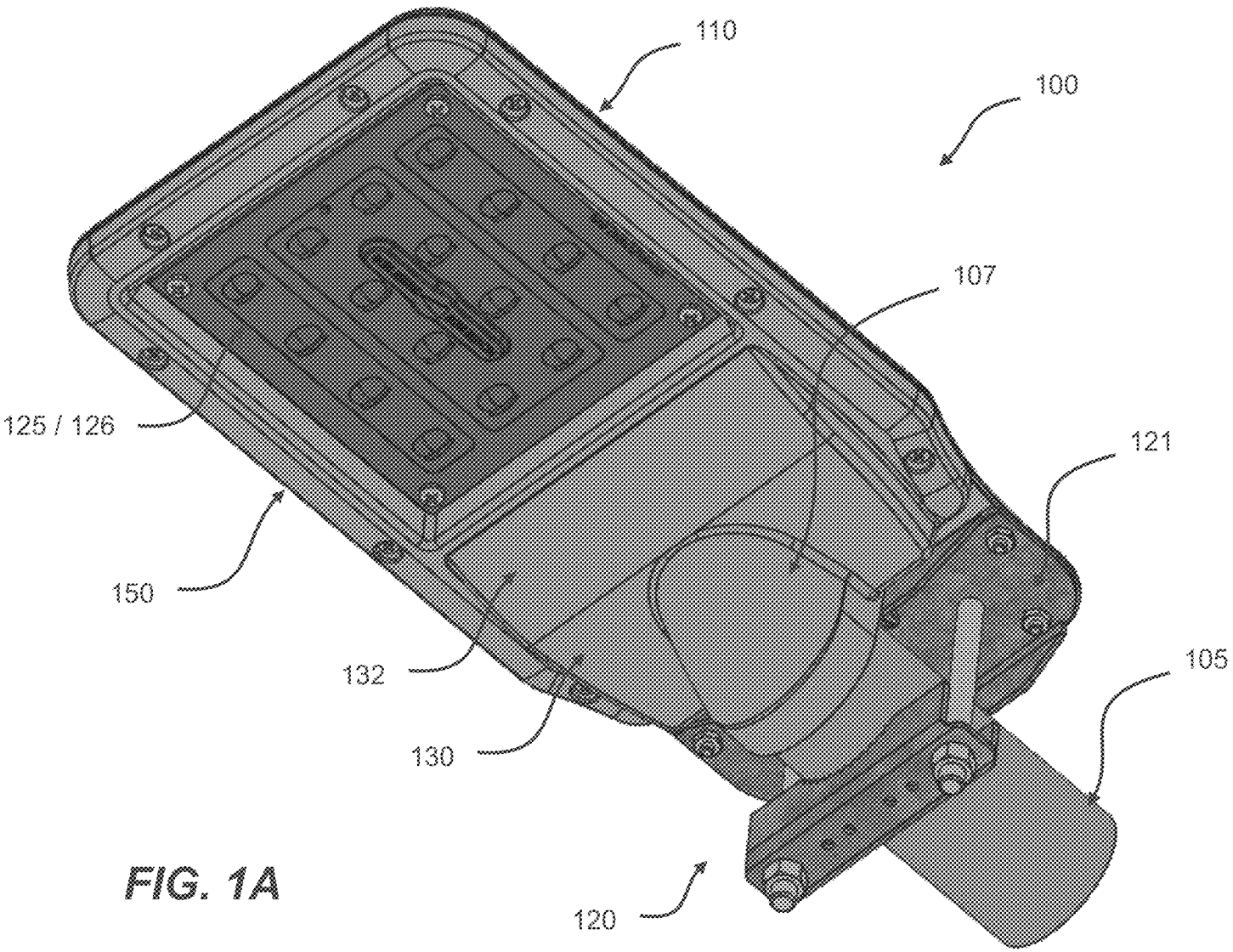
FIGS. 1A, 1B, and 1C (collectively FIG. 1) illustrate three views of a lighting fixture in accordance with some example embodiments of the present disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

As will be discussed in further detail below, some example embodiments of a lighting fixture can comprise an electrical circuit that is attached to a sheet of metal, with a layer of dielectric material positioned between the circuit and the sheet of metal. The layer of dielectric material can provide electrical insulation between the electrical circuit and the sheet of metal. In some embodiments, the dielectric material comprises a film or coating applied to the sheet of metal. The sheet of metal and the insulating layer can comprise a substrate for the circuit. In some example embodiments, the sheet of metal provides a ground plane for the electrical circuit. In some example embodiments, the sheet of metal provides electrical shielding for the electrical circuit. In some example embodiments, the sheet of metal may have a thickness in a range from approximately 0.01 inches to approximately 0.25 inches. Other embodiments may utilize other appropriate thicknesses that may be above or below that range, for example.

The electrical circuit can provide electricity for one or more light emitting diodes. In some example embodiments, the circuit comprises the light emitting diodes, so that the light emitting diodes are mounted adjacent the sheet of metal. In some example embodiments, an array of light emitting diodes is attached to the sheet of metal, and the layer of dielectric material electrically insulates the light emitting diodes from the sheet of metal.

In some example embodiments, each light emitting diode has an associated optic that manages emitted light. In some example embodiments, an array of such optics is mounted adjacent an array of light emitting diodes. The array may be two dimensional in some embodiments, for example. In some example embodiments, a sheet of pliable material, such as gasket material, is disposed between the array of optics and the layer of dielectric material to provide environmental protection, including to protect against moisture ingress.

Some representative embodiments will be further described hereinafter with example reference to the accompanying drawings that describe representative embodiments of the present technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

Figure 1B:
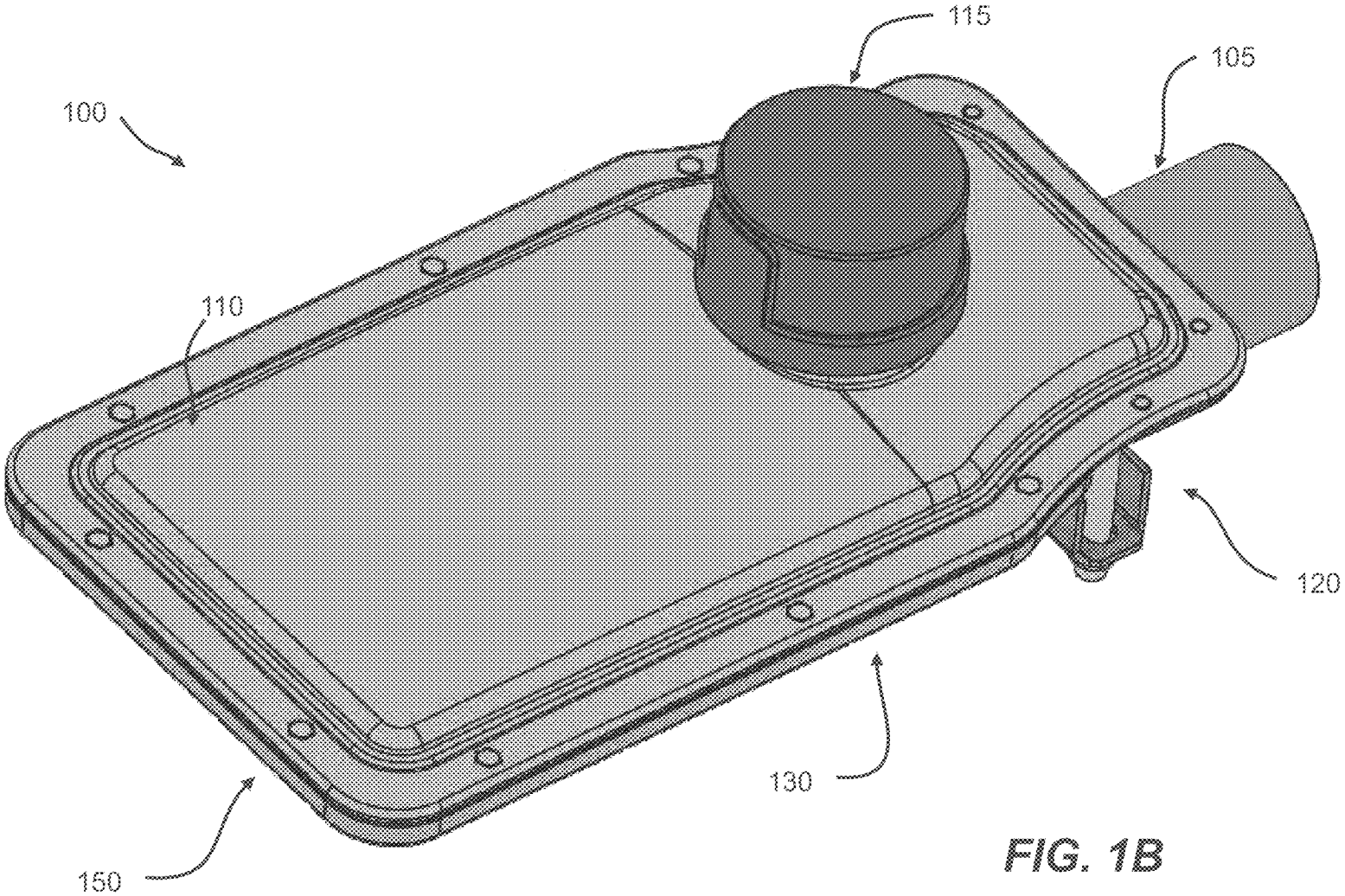
Figure 1C:
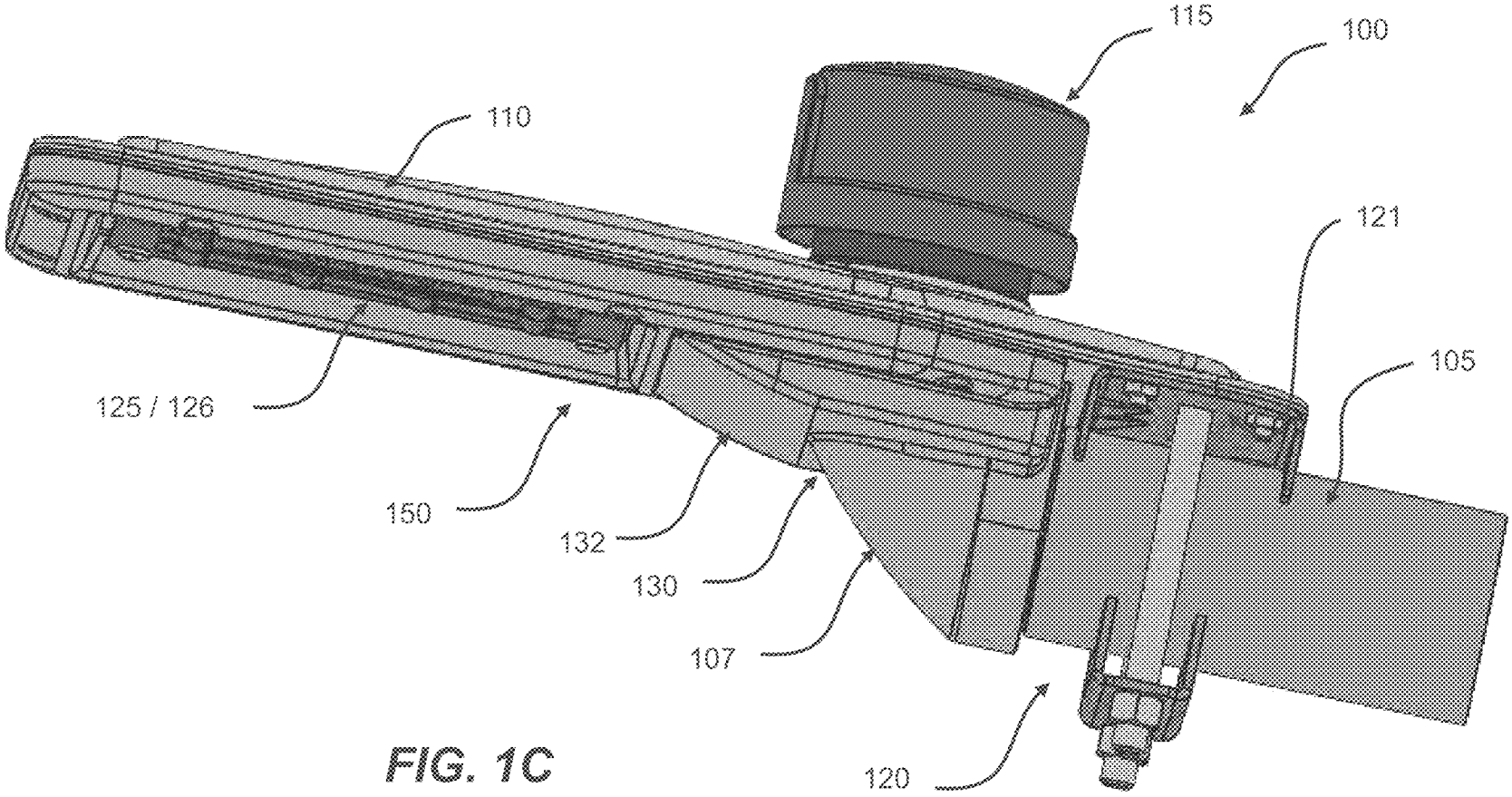

Turning now to FIGS. 1A, 1B, and 1C, these figures illustrate three views of an example lighting fixture 100 in accordance with some embodiments of the present disclosure. FIG. 1A illustrates a perspective view of the underside of the lighting fixture 100. FIG. 1B illustrates a perspective view of the top of the lighting fixture 100. And, FIG. 1C illustrates a side view in perspective.

In the illustrated example, the lighting fixture 100 comprises an outdoor luminaire, specifically a pole-mounted streetlight. A clamp 120 attaches the lighting fixture 100 to the end of a pole 105. The clamp 120 comprises a bracket 121 that provides vibration support. The lighting fixture 100 comprises an integral shroud 107 adjacent the clamp 120 that covers the end of the pole 105.

As illustrated, the lighting fixture 100 comprises an array of light emitting diodes 126 for emitting light and a corresponding array of optics 125 for directing the emitted light to provide a desirable illumination pattern. In other embodiments, a single light emitting diode may be utilized.

A light shield 150 extends about the periphery of the array of optics 125. The light shield 150 prevents the emitted light from traveling skyward, thus suppressing light pollution. In other words, the light shield 150 occludes rays of light oriented in an unintended direction, for example skyward. In some embodiments, the light shield 150 is a unitary element. In other embodiments, the light shield 150 comprises multiple components.

A cover 110 provides environmental protection for the lighting fixture 100. The cover 110 further facilities thermal transfer of heat generated in connection with producing light from electricity. In some embodiments, the cover 110 is a unitary element. In other embodiments, the cover 110 comprises multiple components.

A photocontroller 115 is mounted on top of the cover 110. The photocontroller 115 senses ambient light level, turns the lighting fixture 100 on when the ambient light level is low, for example at dusk, and turns the lighting fixture 100 off in daylight conditions. In some embodiments, the photocontroller 115 can comprise multiple sensors, including an occupancy sensor or personnel sensor, for example. In some embodiments, the photocontroller 115 can be replaced by one or more other types of sensors, for example an occupancy sensor or personnel sensor. In some embodiments, such an occupancy sensor may be mounted on the light emitting side of the lighting fixture, for example.

The illustrated lighting fixture 100 further comprises a cover 130 on the fixture's light-emitting underside that provides an environmentally protected space for electrical elements. In some embodiments, the cover 130 is a unitary element. In other embodiments, the cover 130 comprises multiple components. In the illustrated embodiment, an opening 131 (visible in FIGS. 3A and 3B) that provides passage for lead wires. In an example embodiment, the opening has an associated grommet that helps avoid abrasion of the lead wires.

In some embodiments, one or more sensors can be mounted to the cover 130, for example an occupancy or personnel sensor that detects presence of one or more people utilizing passive infrared sensing or other appropriate technology. In various embodiments, the cover 130 can comprise one or more holes, apertures, or windows for mounting such sensors, surge protection, and/or other appropriate devices. For example, such holes can be located in an area 132 of the cover 130 near the shroud 107.

In various embodiments, the cover 130 can have various electronic components mounted to the inside of the cover 130 or to the outside of the cover 130. In some example embodiments, the cover 130 has a recessed shape. In some example embodiments, the cover 130 has a substantially flat shape.

Figure 2A:
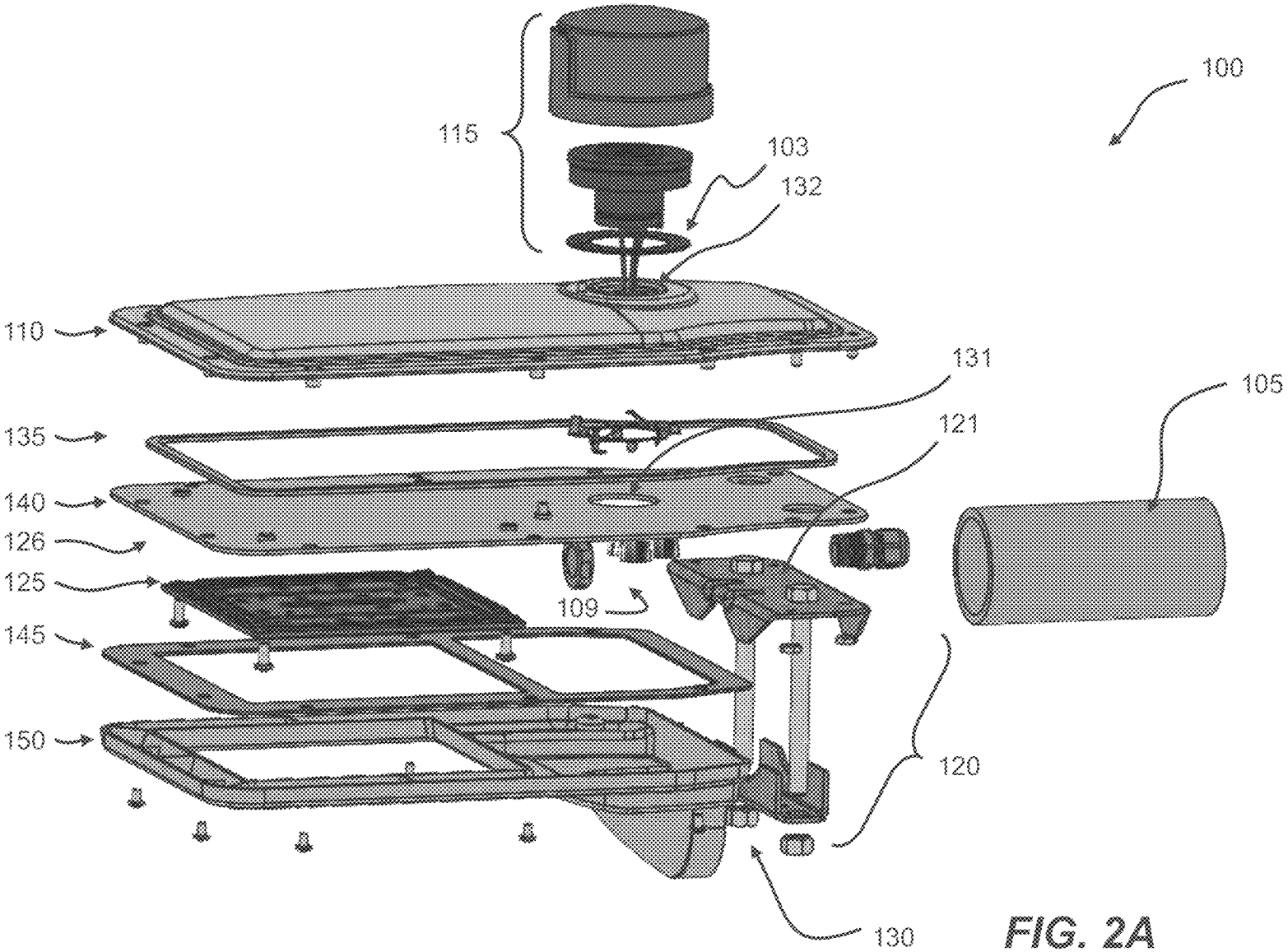
FIGS. 2A and 2B (collectively FIG. 2) illustrate two exploded views of the lighting fixture illustrated in FIG. 1 in accordance with some example embodiments of the present disclosure.
Figure 2B:
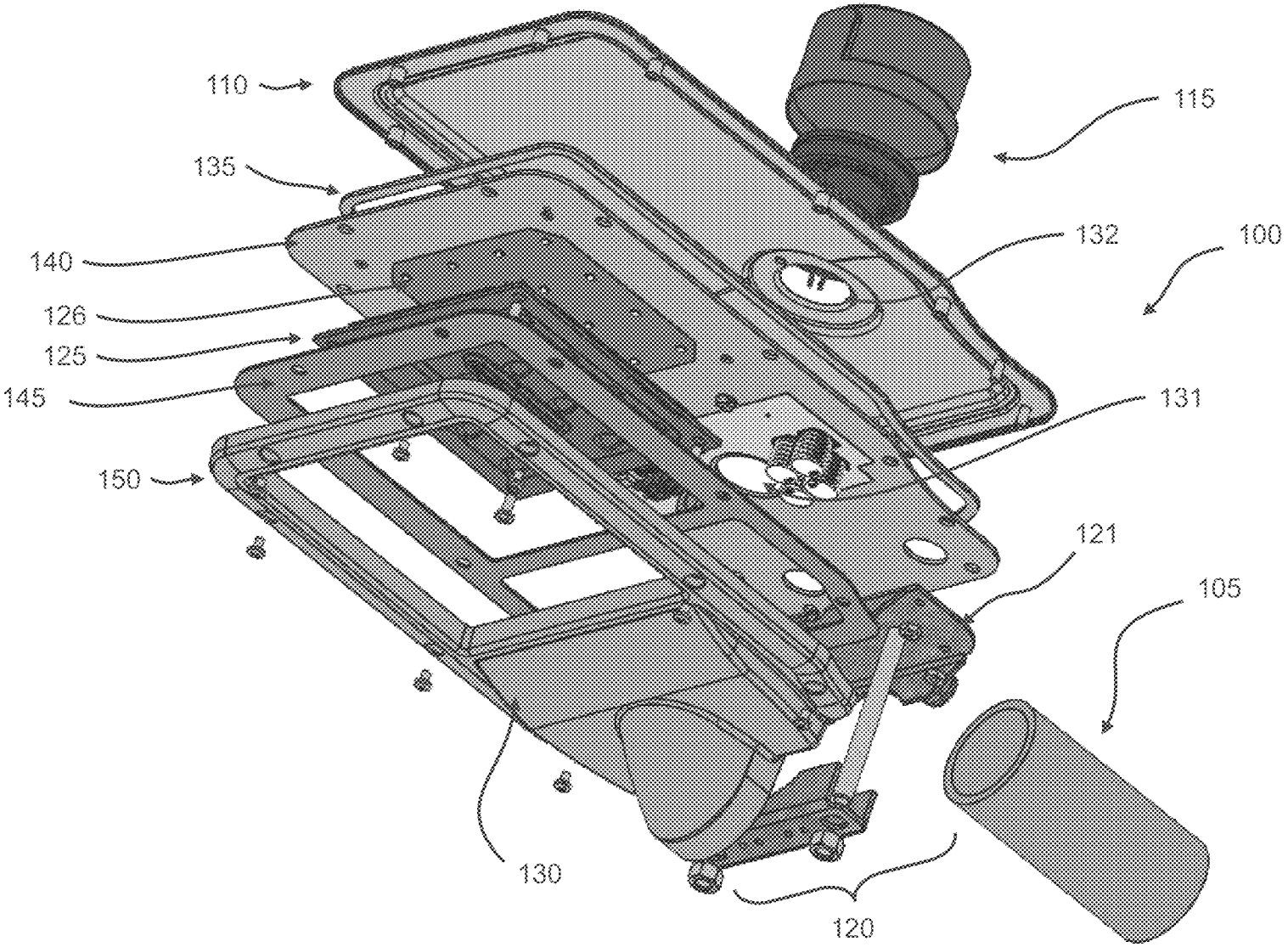

Turning now to FIGS. 2A and 2B, these figures illustrate two exploded views of the example lighting fixture 100 initially illustrated in FIG. 1 and discussed above in accordance with some embodiments of the present disclosure. FIG. 2A illustrates a side perspective view of the exploded assembly, while FIG. 2B illustrates a bottom perspective view of the exploded assembly.

In the illustrated example embodiment, a gasket 135 is located between the cover 110 and the sheet of metal 140. The gasket 135 provides environmental protection, including against moisture ingress.

In some example embodiments, the sheet of metal 140 is flat or substantially flat. As discussed above, circuitry, including light emitting diodes 126, is mounted to the lower side of the sheet of metal 140. In some example embodiments, the sheet of metal 140 can comprise one or more recesses. In some example embodiments, the sheet of metal 140 is contoured on one or both sides, for example.

The photocontroller 115 is mounted at the upper surface of the cover 110 as discussed above. A gasket 103 is located between the cover 110 and the photocontroller 115 and seals around the periphery of the photocontroller 115. The gasket 103 can prevent ingress of water or dust.

A sheet of gasket material 145 is located between the array of optics 125 and the light shield 150, which functions as a frame. The sheet of gasket material 145 seals the light emitting diodes 126 and circuitry against moisture ingress.

In some example embodiments, the light emitting diode circuit comprises circuitry printed on a layer of insulating material that has been coated on the sheet of metal 140. The circuitry may include light emitting diodes 126, electrical traces, and/or one or more light emitting diode drivers 109. In some example embodiments, the light emitting diode circuitry comprises a printed circuit board that is mounted to or disposed against the sheet of metal 140. For example, light emitting diodes can be attached to a circuit board, with the circuit board fastened to or otherwise supported by the sheet of metal 140.

The light shield 150 extends around the array of optics 125 and light emitting diodes 126 as discussed above. The cover 130 is located on the pole side of the array of optics 125 and can provide light shielding as well as an enclosed space.

Figure 3B:
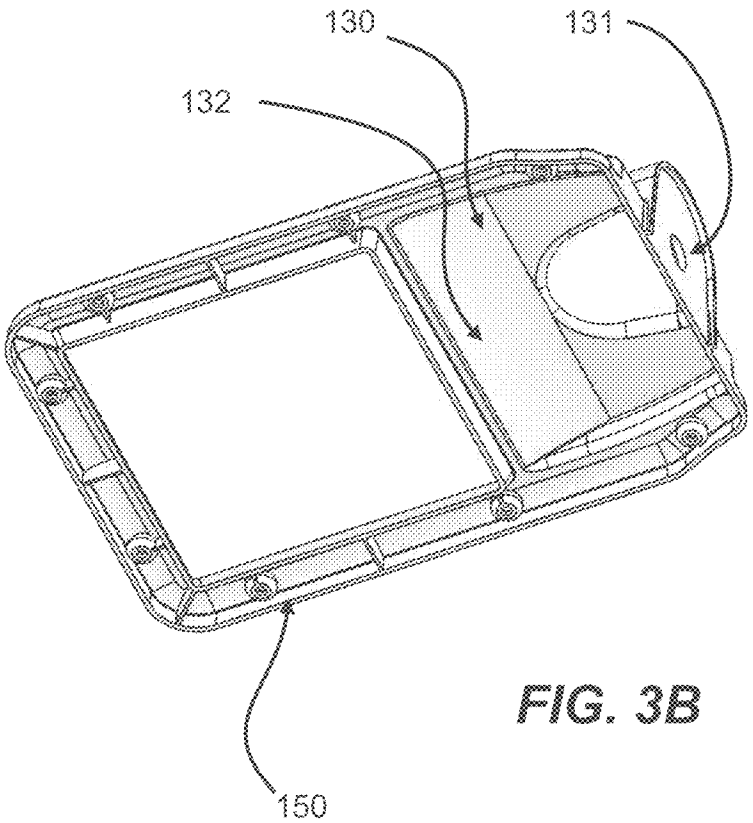
FIGS. 3A and 3B (collectively FIG. 3) illustrate two views of an integrated cover and shield of the lighting fixture illustrated in FIGS. 1 and 2 in accordance with some example embodiments of the present disclosure.
Figure 3A:
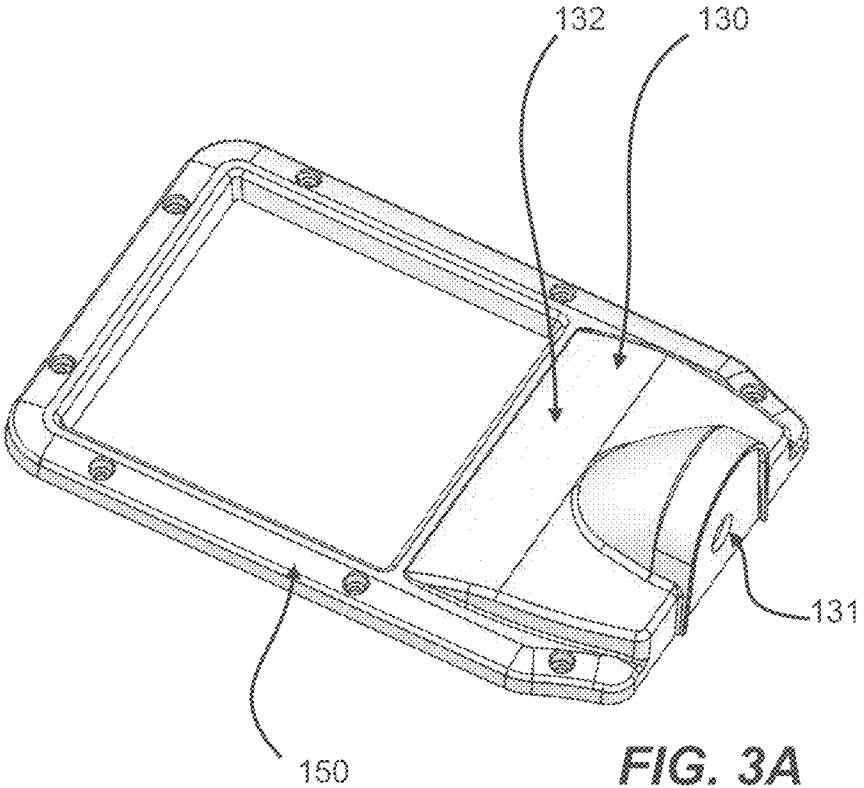

Turning now to FIGS. 3A and 3B, these figures illustrate two views of the integrated cover 130 and shield 150 of the example lighting fixture 100 illustrated in FIGS. 1 and 2 and discussed above in accordance with some embodiments of the present disclosure. FIG. 3A illustrates a perspective view of the side of the integrated cover 130 and light shield 150 that faces outward when mounted on the lighting fixture 100 as illustrated in FIGS. 1 and 2. FIG. 3B illustrates a perspective view of the opposite side of the integrated cover 130 and light shield 150, which faces inward when mounted on the lighting fixture 100 as illustrated in FIGS. 1 and 2.

The inward facing side of the cover 130 is recessed to provide space for housing electrical components, including wiring. As shown in FIGS. 2A and 2B, the gasket 145 extends around the periphery of the integrated cover 130 and light shield 150 to seal the space environmentally.

The cover 130 provides an enclosed space that is under an opening 131 (illustrated in FIGS. 2A and 2B) in the sheet of metal 140, and that opening 131 is aligned with the photocontroller 115 and the associated opening 132 in the cover 110. Accordingly, wiring feeds between the enclosed space of the cover 130 and the photocontroller 115. However in some embodiments, the cover 110 does not have such an opening.

Figure 4A:
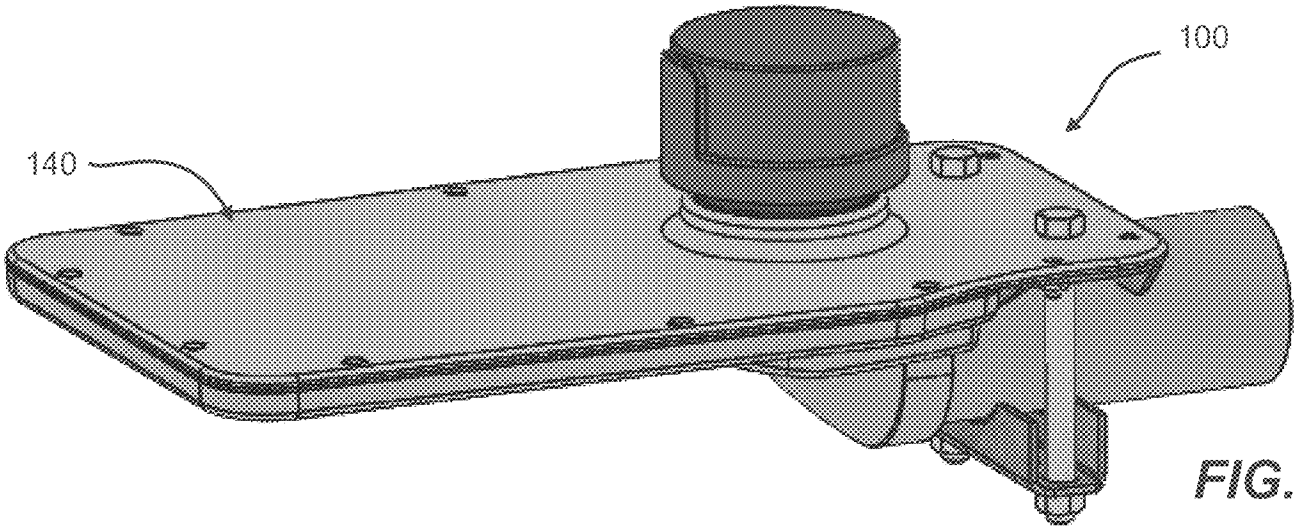
FIGS. 4A and 4B (collectively FIG. 4) illustrate two views of the lighting fixture illustrated in FIGS. 1 and 2, with the upper cover removed and installed, in accordance with some example embodiments of the present disclosure.
Figure 4B:
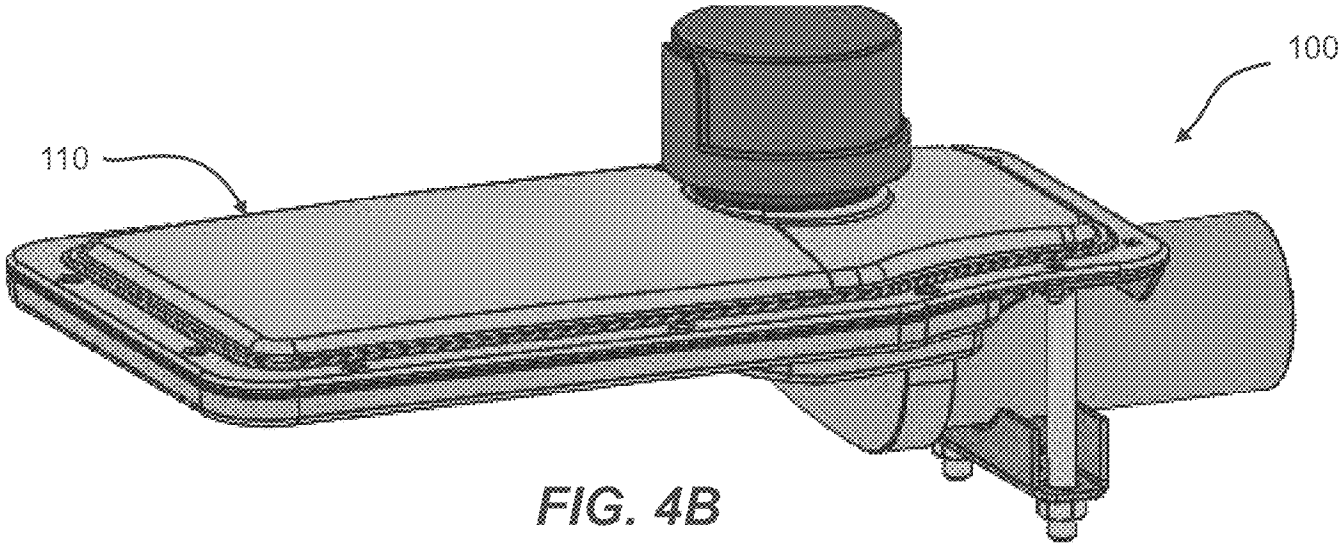

Turning now to FIGS. 4A and 4B, these figures illustrate two views of the example lighting fixture 100 illustrated in FIGS. 1 and 2 and discussed above in accordance with some embodiments of the present disclosure. FIG. 4A illustrates the lighting fixture 100 with the cover 110 removed to expose the sheet of metal 140. FIG. 4B illustrates the lighting fixture 100 with the cover 110 attached.

As illustrated in FIG. 4B, the cover 110 is slanted and contoured to prevent rainwater from accumulating on the top of the lighting fixture 100. In other words, the cover is formed to shed water, such as rainwater.

Figure 5B:
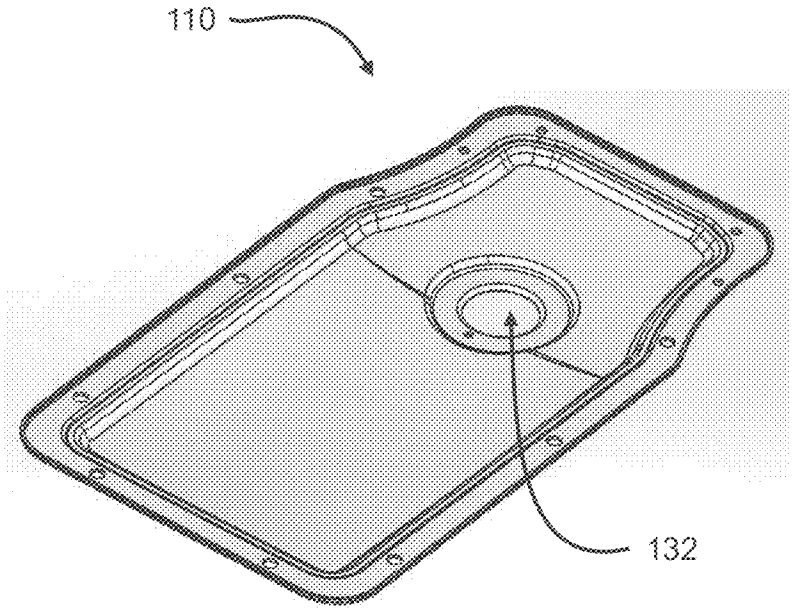
FIGS. 5A and 5B (collectively FIG. 5) illustrate perspective top and bottom views of the lighting fixture cover in accordance with some example embodiments of the present disclosure.
Figure 5A:
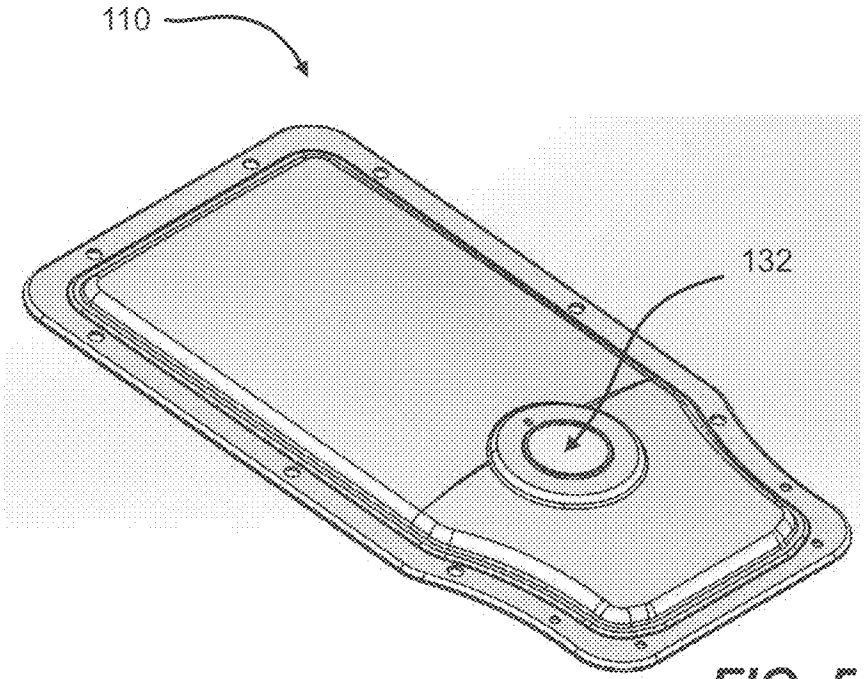

Turning now to FIGS. 5A and 5B, these figures respectively illustrate perspective top and bottom views of the cover 110 in accordance with some example embodiments of the present disclosure. As illustrated in FIGS. 2A and 2B, a gasket 135 can extend around the periphery of the cover 110 for environmental sealing. The cover 110 can comprise a gasket groove in which the gasket 110 is seated, for example.

In some embodiments, the cover 110 can comprise metal inserts for holding other components or for mounting. For example, the cover 110 can comprise fastening elements molded or otherwise inserted.

The views of FIG. 5 further illustrate the water-shedding contours that the cover 110 provides the lighting fixture 100 as discussed above. Additionally, FIG. 5 shows a representative form for the portion of the cover 110 to which the photocontroller 115 is mounted as discussed above.

Figure 6A:
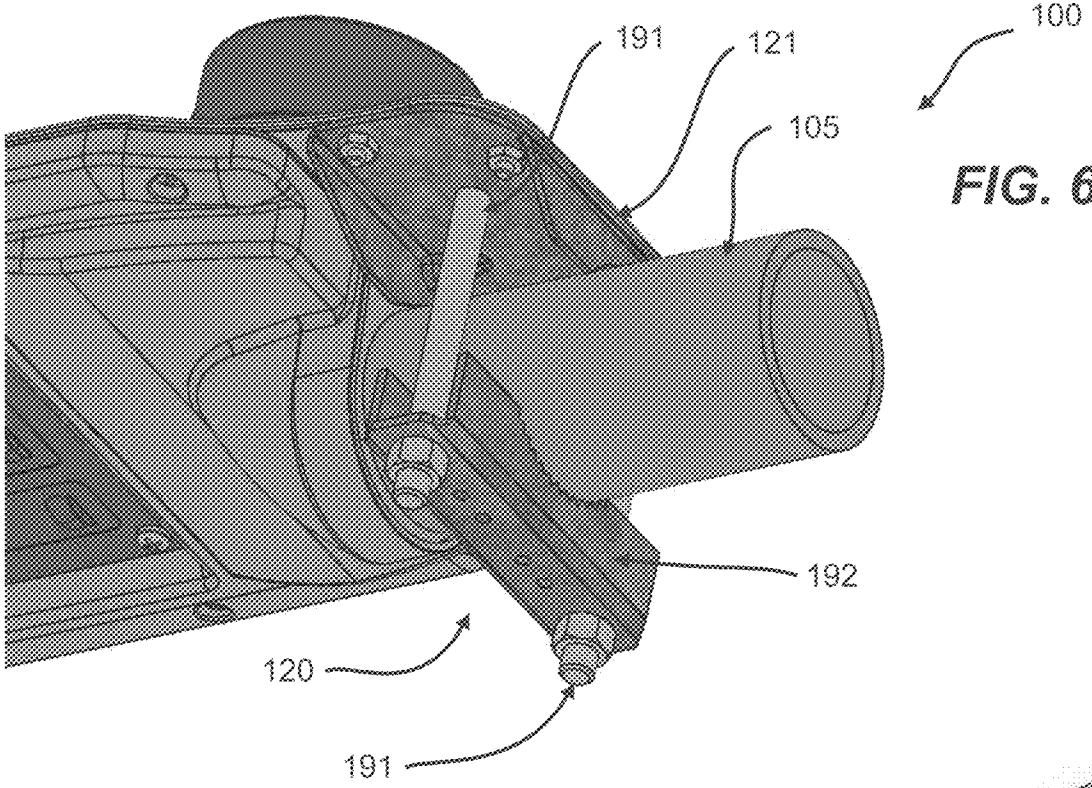
FIGS. 6A, 6B, 6C, and 6D (collectively FIG. 6) illustrate an attachment system for mounting the lighting fixture to the pole in accordance with some example embodiments of the present disclosure.
Figure 6B:
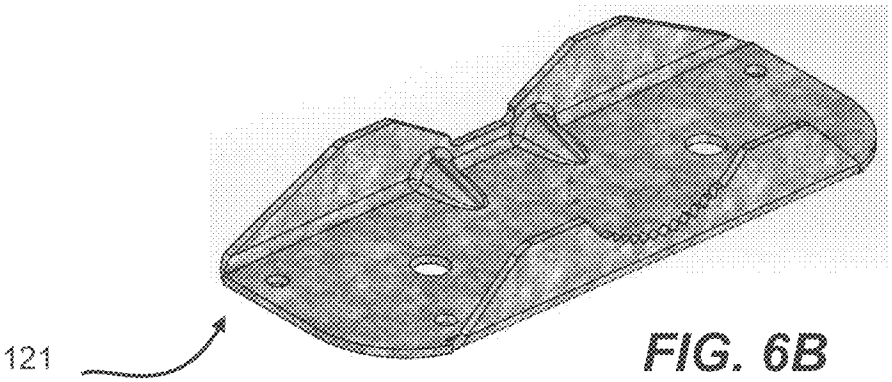
Figure 6C:
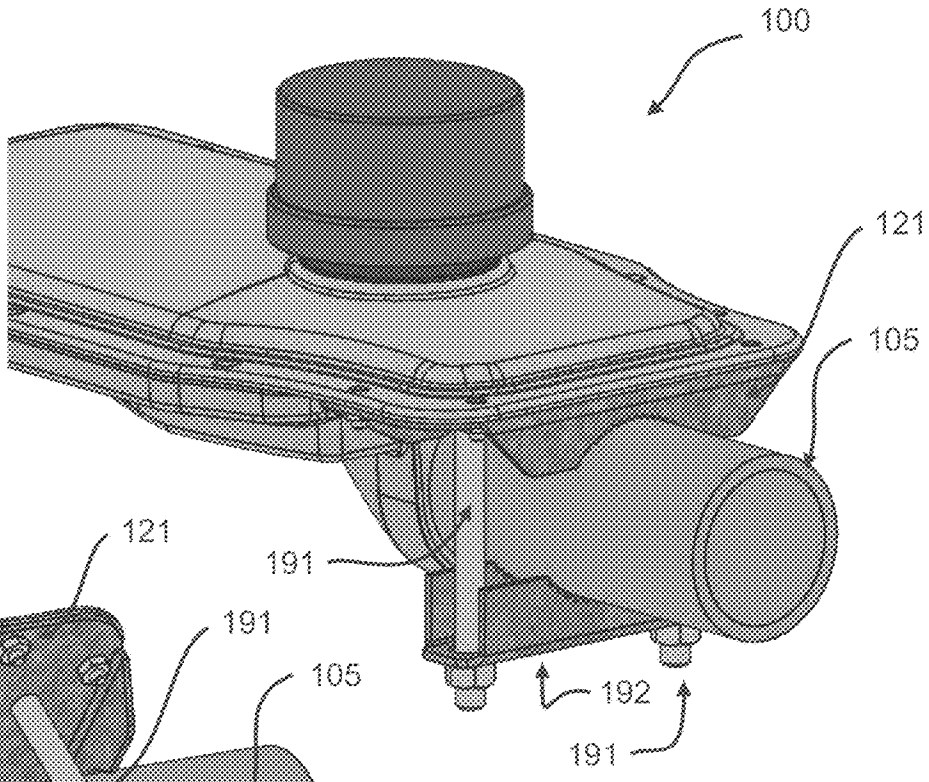
Figure 6D:
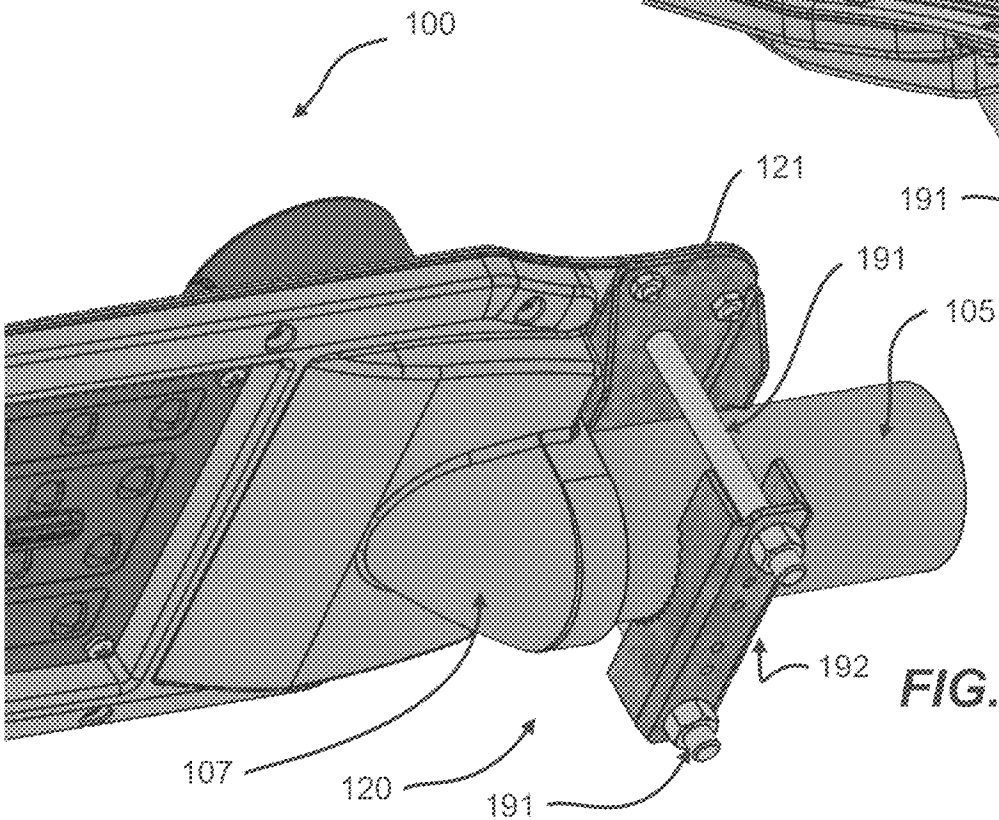

Turning now to FIGS. 6A, 6B, 6C, and 6D, these figures illustrate an example attachment system for mounting the lighting fixture 100 to the pole 105 in accordance with some embodiments of the present disclosure. FIG. 6A illustrates a perspective view of the clamp 120 with the bracket 121 included. FIG. 6B illustrates a perspective view of the bracket 121. FIG. 6C illustrates another perspective view of the clamp 121 and the associated bracket 121. FIG. 6D illustrates another perspective view of the clamp 121 and the associated bracket 121.

The clamp 121 comprises bolts 191 that apply clamping force around the pole 105 in order to set and maintain the position of the lighting fixture 100 at the pole end. The bracket 121 is positioned on the upper side of the pole 105 and stabilizes the lighting fixture 100, including for vibration support. The collar 192 of the clamp 121 can accommodate poles 105 of varying diameters, as the bottom band that spans across one side of the pole is deformable relative to the upper member.

In some example embodiments, the clamp 121 comprises a lower pole mounting plate with stamped-in ramps that allow the lighting fixture 100 to be mounted at multiple angles on the pole 105. See for example FIGS. 6A and 6B.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a sheet of metal comprising a lower side, a first fastening aperture arranged to receive a first fastener, and a second fastening aperture arranged to receive a second fastener, the first fastening aperture and the second fastening aperture disposed at a mounting end of the sheet of metal;

a layer of dielectric material disposed on the lower side of the sheet of metal;

a light emitting diode light source disposed on the lower side of the sheet of metal with the layer of dielectric material disposed between the light emitting diode light source and the sheet of metal;

a driver disposed on the sheet of metal; and a clamp comprising a bracket and a collar arranged to be joined by the first fastener and the second fastener about a mounting pole, the bracket attached to the mounting end of the sheet of metal.

2. The luminaire of claim 1, further comprising:

an optic mounted adjacent the light emitting diode light source;

a pliable material disposed between the optic and the layer of dielectric material to provide environmental protection; and a cutoff shield extending at least partially around a periphery of the optic.

3. The luminaire of claim 2, further comprising a gasket disposed between the cutoff shield and the lower side of the sheet of metal.

4. The luminaire of claim 2, further comprising:

a cover mounted adjacent a top side of the sheet of metal, with a gasket disposed between the cover and the sheet of metal.

5. The luminaire of claim 4, further comprising a photocontroller mounted on the cover.

6. The luminaire of claim 1, further comprising:

a shroud that covers an end of the mounting pole.

7. The luminaire of claim 1, further comprising a cover that is mounted adjacent a top side of the sheet of metal and that is slanted relative to the sheet of metal so that rainwater drains from the cover.

8. The luminaire of claim 1, wherein the luminaire is a streetlight.

9. The luminaire of claim 1, wherein the driver is disposed on a second layer of dielectric material on the lower side of the sheet of metal.

10. The luminaire of claim 1, wherein the sheet of metal has a thickness in a range from approximately 0.01 inches to approximately 0.15 inches.

11. A light module comprising:

a sheet of metal comprising a lower side, a first fastening aperture arranged to receive a first fastener, and a second fastening aperture arranged to receive a second fastener, the first fastening aperture and the second fastening aperture disposed at a mounting end of the sheet of metal;

a circuit that comprises one or more light emitting diodes disposed on the lower side of the sheet of metal;

a driver mounted on the lower side of the sheet of metal;

a light shield mounted to the lower side of the sheet of metal, the light shield comprising an aperture that is aligned with the circuit; and a clamp arranged to be joined by the first fastener and the second fastener to the mounting end of the sheet of metal.

12. The light module of claim 11, wherein the one or more light emitting diodes comprises a two-dimensional array of light emitting diodes, and wherein one or more optics are mounted adjacent the one or more light emitting diodes and comprise a two-dimensional array of optics formed as a sheet.

13. The light module of claim 12, further comprising:

a first gasket disposed between the sheet of optics and the circuit;

a cover mounted adjacent an upper side of the sheet of metal; and a photocontroller mounted on the cover.

14. The light module of claim 11, further comprising:

a cover attached to the light shield and covering the driver.

15. The light module of claim 11, wherein the circuit is printed onto the sheet of metal.

16. A light module comprising:

a sheet of metal;

a clamp disposed at a mounting end of the sheet of metal;

a coating of dielectric material disposed on a lower side of the sheet of metal; and a circuit disposed on the coating of dielectric material, the circuit comprising one or more light emitting diodes; and a driver mounted on the lower side of the sheet metal with the coating of dielectric material disposed between the driver and the sheet of metal.

17. The light module of claim 16, further comprising a photocontroller mounted to an upper surface of the light module.

18. The light module of claim 16, wherein the circuit is printed onto the coating of dielectric material.

19. The light module of claim 16, further comprising a cover that is mounted adjacent an upper side of the sheet of metal, wherein the cover is slanted relative to the sheet of metal so that rainwater drains from the cover.

20. The light module of claim 16, wherein the sheet of metal has a thickness in a range from approximately 0.01 inches to approximately 0.15 inches.

* * * * *